US010876291B2

(12) United States Patent
Yesil

(10) Patent No.: US 10,876,291 B2
(45) Date of Patent: Dec. 29, 2020

(54) COMPOSITE FRAME BRICK EMBODIMENT

(71) Applicants: Renco World Corporation, Miami, FL (US); Kamil Engin Yesil, Istanbul (TR)

(72) Inventor: Kamil Engin Yesil, Istanbul (TR)

(73) Assignee: Renco World Corporation, Miami, FL (US)

( * ) Notice: Subject to any disclaimer, the term of this patent is extended or adjusted under 35 U.S.C. 154(b) by 0 days.

(21) Appl. No.: 16/461,621

(22) PCT Filed: Jun. 7, 2017

(86) PCT No.: PCT/IB2017/000792
§ 371 (c)(1),
(2) Date: May 16, 2019

(87) PCT Pub. No.: WO2018/091954
PCT Pub. Date: May 24, 2018

(65) Prior Publication Data

US 2019/0352902 A1 Nov. 21, 2019

(30) Foreign Application Priority Data

Nov. 21, 2016 (TR) ..... a 2016 16805

(51) Int. Cl.
*E04B 2/08* (2006.01)
*E04C 1/00* (2006.01)
*E04B 2/56* (2006.01)

(52) U.S. Cl.
CPC . *E04C 1/00* (2013.01); *E04B 2/56* (2013.01)

(58) Field of Classification Search
CPC ..... E04B 2/18; E04B 2002/0228; E04B 2002/0206; E04B 2002/0204; E04B 1/54; E04B 2002/0217; E04C 1/39
See application file for complete search history.

(56) References Cited

U.S. PATENT DOCUMENTS 2,911,818 A * 11/1959 Smith ..... E04C 3/02 52/592.3
3,449,878 A 6/1969 Hern
(Continued)

FOREIGN PATENT DOCUMENTS

EP 2339080 A1 6/2011
FR 1520905 A 4/1968
(Continued)

OTHER PUBLICATIONS

International Search Report for PCT/IB2017/000792, dated Oct. 11, 2017.

*Primary Examiner* — Gisele D Ford
(74) *Attorney, Agent, or Firm* — Lerner, David, Littenberg, Krumholz & Mentlik, LLP

(57) ABSTRACT

The present invention is a frame brick (10) having a brick body (12) made of composite material and which is in hollow box form and which comprises at least one type of fiber and at least one type of resin, and at least one connection extension (15) which is one-piece with said brick body (12) and which provides connection to another structure element with the same characteristics. As an improvement, at least one cutout (201) is provided at least partially in the direction of the height of the brick body (12) on at least one of two wall surfaces (20) extending mutually on a brick length section (19) of the brick body (12).

26 Claims, 13 Drawing Sheets

(56) References Cited

U.S. PATENT DOCUMENTS

| | | | | | |
|---|---|---|---|---|---|
| 3,905,170 | A * | 9/1975 | Huettemann | E04B 2/14 | 52/591.1 |
| 5,992,102 | A * | 11/1999 | Ozawa | E04B 2/44 | 52/100 |
| 7,694,485 | B1 | 4/2010 | Siener | | |
| 8,671,640 | B1 * | 3/2014 | Thomas | E04B 2/18 | 446/122 |
| 9,783,986 | B2 * | 10/2017 | Yesil | E04B 2/18 | |
| 9,834,932 | B2 * | 12/2017 | Yesil | E04B 2/18 | |
| 2015/0107176 | A1 | 4/2015 | Cetindag | | |

FOREIGN PATENT DOCUMENTS

| | | | |
|---|---|---|---|
| WO | 2015089099 | A1 | 6/2015 |
| WO | 2015130245 | A1 | 9/2015 |

* cited by examiner

COMPOSITE FRAME BRICK EMBODIMENT

CROSS-REFERENCE TO RELATED APPLICATIONS

The present application is a national phase entry under 35 U.S.C. § 371 of International Application No. PCT/IB2017/000792, filed Jun. 7, 2017, which claims priority from Turkish Patent Application No. 2016/16805, filed Nov. 21, 2016, all of which are incorporated herein by reference.

TECHNICAL FIELD

The present invention relates to a frame brick having a brick body made of composite material and which is in a form similar to a hollow box and comprising at least one type of fiber and at least one type of resin, and at least one connection extension which is one-piece with said brick body, for providing connection to another structure element with the same characteristics.

PRIOR ART

Structures which are frequently used in construction sector are made of brick and steel-based materials. Structures have carrier walls which carry the load and intermediate walls forming compartments inside the building. While mostly concrete material or materials which can carry load is/are preferred for the carrier walls, intermediate walls of structures are generally formed by ytong, block, brick aluminum frame carcass plaster boards. Since most of said intermediate wall materials are very heavy, they exert excessive load to the building. This increases the transportation costs since these materials are heavy. Moreover, while the intermediate walls are formed, additional material like adhesive, mortar shall be used and additional labor like plastering is required. For plaster board usage, a frame carcass shall be used and additional labor requirements like carrying of the profiles, cutting and joining of the profiles occur in order to form the frame carcass.

Insulation inside the buildings is an important issue and it is a factor which substantially affects the preference level of the building. The intermediate walls made of the abovementioned materials cannot meet the requested values in terms of thermal and noise insulation. Besides, since the humidity permeability of said materials is high, the intermediate walls are affected by humidity.

As a result, because of all of the abovementioned problems, an improvement is required in the related technical field.

BRIEF DESCRIPTION OF THE INVENTION

The present invention relates to frame brick and walls formed by frame bricks, for eliminating the above mentioned disadvantages and for bringing new advantages to the related technical field.

An object of the present invention is to provide a structure element which is lightened without a reduction in the resistance thereof.

Another object of the present invention is to reduce the cost of the structure element and of the structure formed by the structure element.

Another object of the present invention is to provide a structure element and structure of which the thermal and noise insulation is increased.

Another object of the present invention is to provide a structure of which the assembly and installment processes are facilitated.

In order to realize all of the abovementioned objects and the objects which are to be deducted from the detailed description below, the present invention is a frame brick having a brick body made of composite material and which is in hollow box form and which comprises at least one type of fiber and at least one type of resin, and at least one connection extension which is one-piece with said brick body and which provides connection to another structure element with the same characteristics. Accordingly, as an improvement, at least one cutout is provided at least partially in the direction of the height of the brick body on at least one of two wall surfaces extending mutually on a brick length section of the brick body.

In a preferred embodiment of the invention, at least one first wall corner of the cutout is curved.

In a preferred embodiment of the invention, the cutout is present on both wall surfaces.

In a preferred embodiment of the invention, at least one production opening is provided which is positioned on at least one joining line provided between the connection extensions.

In a preferred embodiment of the invention, at least one connection recess or at least one connection protrusion is provided on at least one of the side surfaces facing another frame brick which is horizontally adjacent.

In a preferred embodiment of the invention, the brick body comprises at least one brick cell.

In a preferred embodiment of the invention, the brick body comprises pluralities of brick cells arranged side by side in a one-piece manner.

In a preferred embodiment of the invention, one cutout is provided on the wall surface of two adjacent brick cells.

In a preferred embodiment of the invention, at least one support part is provided which extends along at least one section of the height of the brick body in a manner contacting the two wall surfaces in an inner gap of the brick body.

In a preferred embodiment of the invention, at least one passage opening is provided on the support part at least partially in the direction of the height of the brick body.

In a preferred embodiment of the invention, at least one passage opening is provided at least partially in the direction of the height of the brick body on at least one of the side surfaces facing another frame brick which is horizontally adjacent.

In a preferred embodiment of the invention, at least one second wall corner of the passage opening is curved.

In a preferred embodiment of the invention, the connection extensions are provided on each brick cell provided in the brick length section.

In a preferred embodiment of the invention, the connection extensions are provided respectively on one of the two brick cells provided in the brick length section.

In a preferred embodiment of the invention, two brick cells are provided in a brick width section of the frame brick.

In a preferred embodiment of the invention, the width of a cell width part of at least one of the outermost brick cells in the brick length section is smaller than the width of the brick width section.

In a preferred embodiment of the invention, the subject matter frame brick is made of a composite material comprising at least one type of fiber between 25-33% by weight for providing resistance, at least one type of mineral powder between 40-50% by weight as filling material, at least one type of resin between 20-25% by weight as binding the fiber to the filling material and at least one chemical additive between 5-8%.

In a preferred embodiment of the invention, vinyl ester resin is provided as resin and carbon fiber is provided as fiber, in order to obtain a material having the mechanical properties of steels which are ST 50 and above.

In a preferred embodiment of the invention, ortophthalic resin is provided as resin and glass fiber is provided as fiber, in order to obtain a material having the mechanical properties of steels which are between ST 33 and ST 42.

In a preferred embodiment of the invention, isophthalic resin is provided as resin and aramid fiber is provided as fiber, in order to obtain a material having the mechanical properties of steels which are between ST 42 and ST 50.

In a preferred embodiment of the invention, as filling material, at least one type of mineral powder is provided which is selected from a mineral group comprising silicium dioxide, barite, talc and calcite.

In a preferred embodiment of the invention, as the chemical additive, at least one of chemicals which increase resistance to water absorption, resistance to flame and resistance to abrasion is provided and moreover, optionally, predetermined proportion of thermoplastic material is provided for improving surface appearance.

In a preferred embodiment of the invention, at least one insulation material is provided in the inner gap of the brick body.

In a preferred embodiment of the invention, at least one coating plate is provided on the wall surface having cutout.

In a preferred embodiment of the invention, the coating plate is at least one of plaster board plate and bordex plate.

In a preferred embodiment of the invention, the subject matter invention is a wall defined by connection of at least two frame bricks to each other.

Figure 7A:
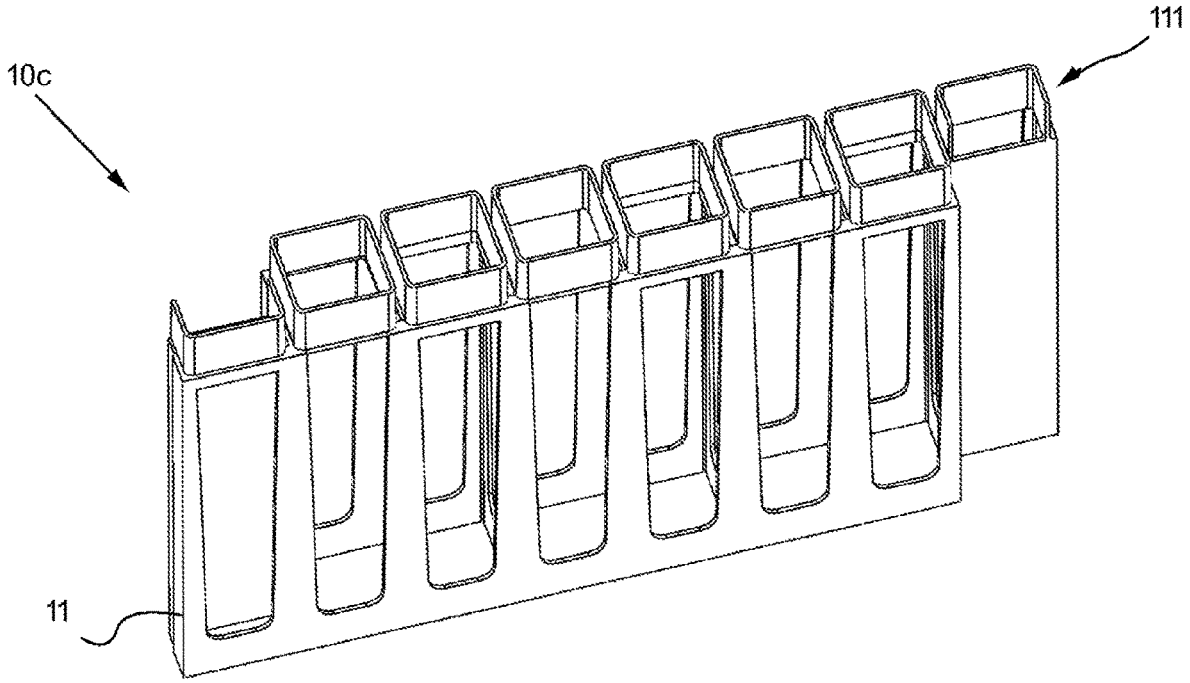
Figure 7B:
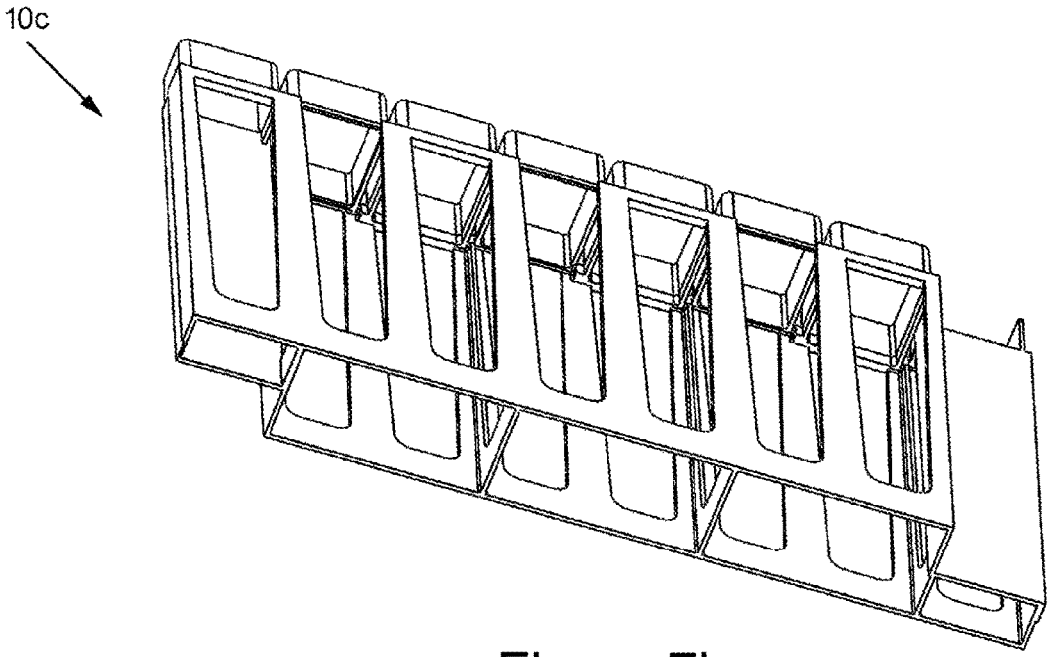
Figure 8A:
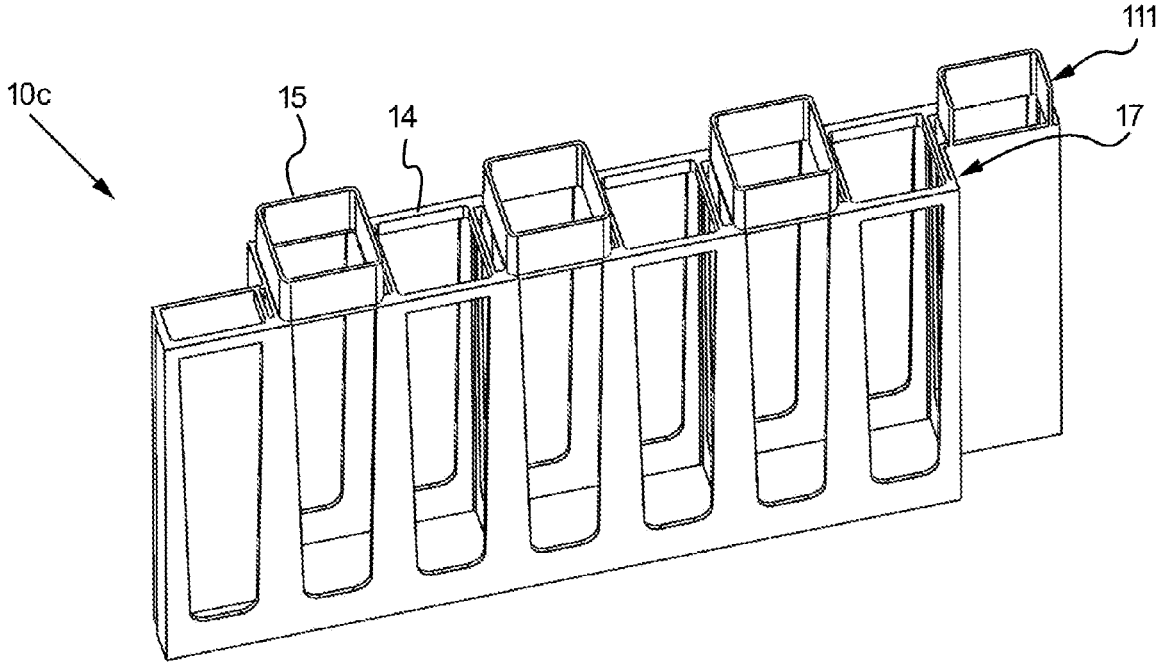
Figure 8B:
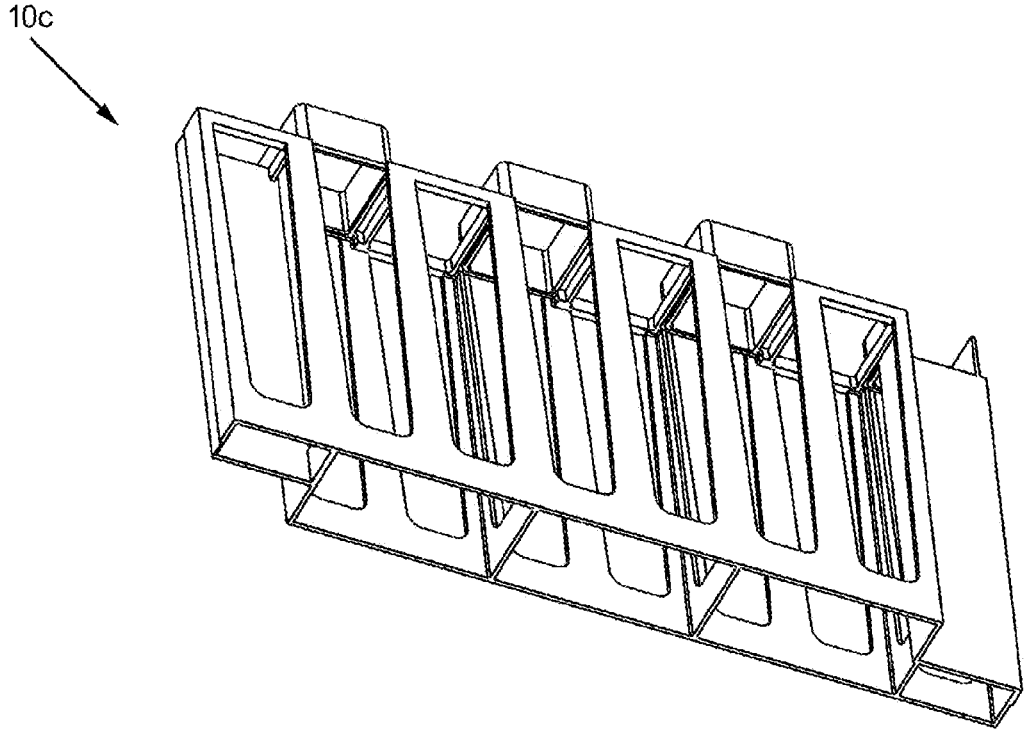
Figure 9A:
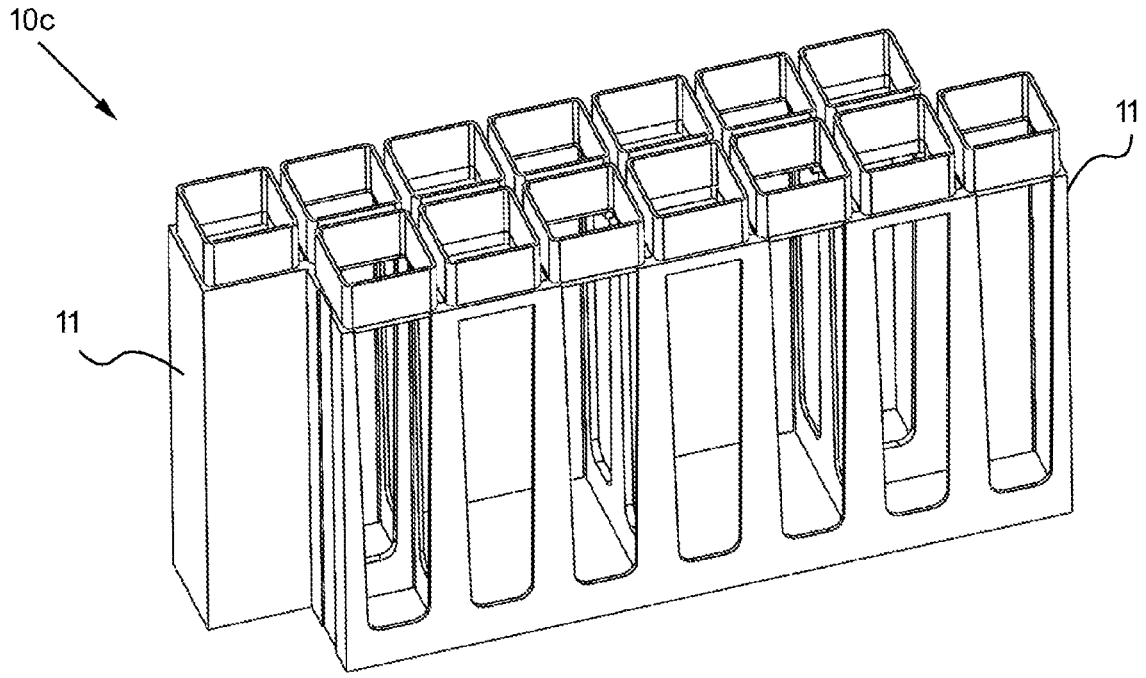
Figure 9B:
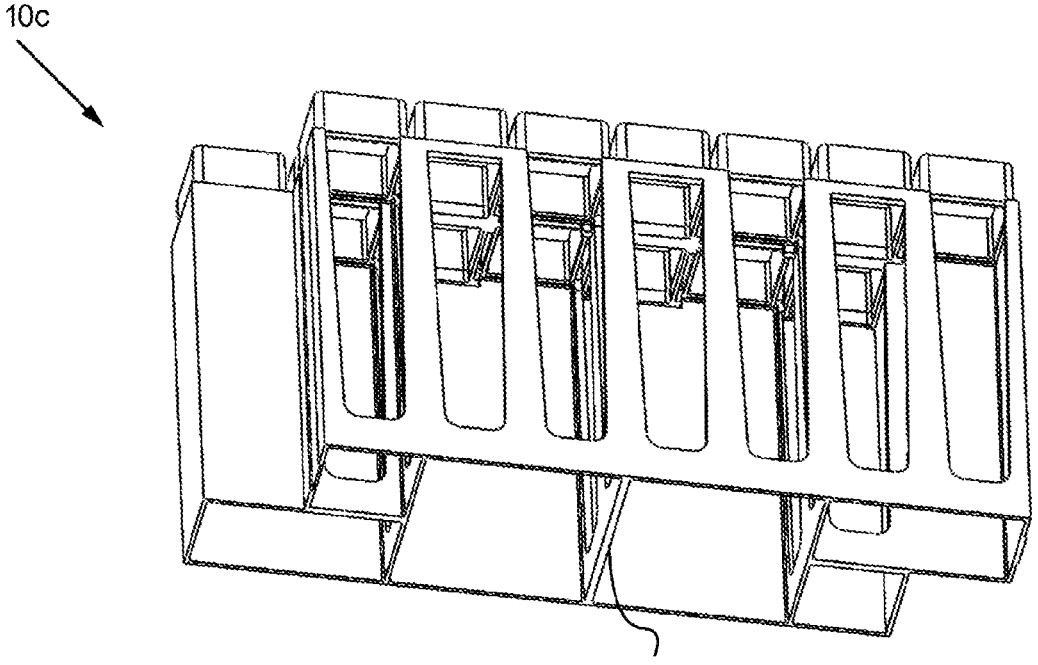
Figure 10A:
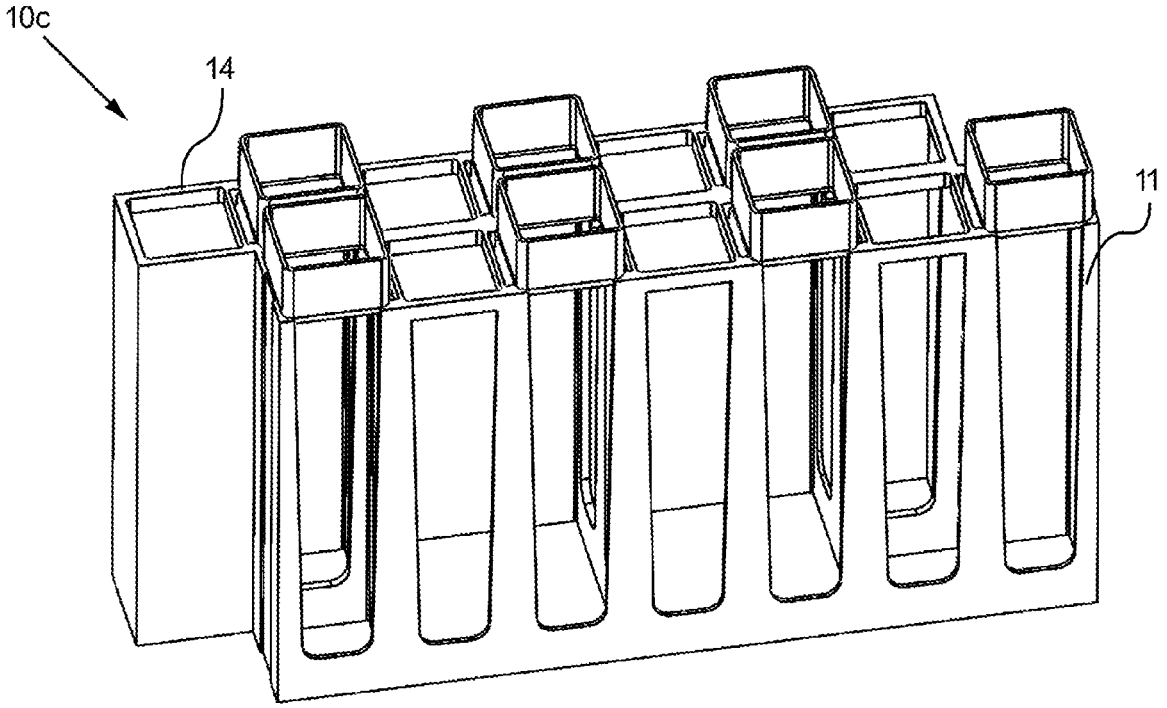
Figure 10B:
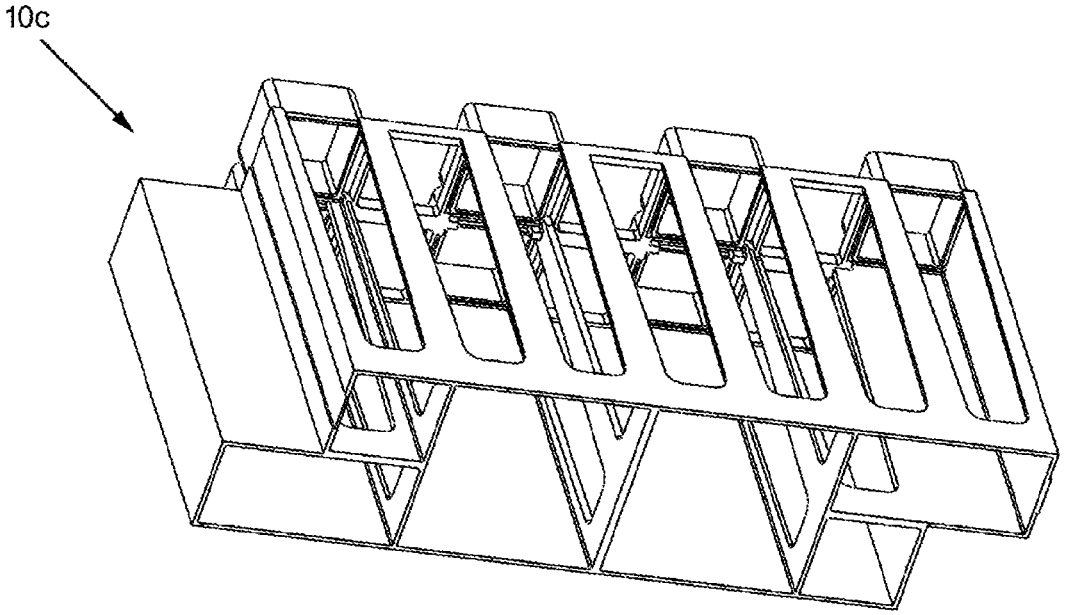

In the figures between FIGS. 7*a* and 10*b*, the representative views of different embodiments of the subject matter sliding frame brick are given.

In FIGS. 11, 12, 13 and 14, the representative views of the walls formed by means of different types of frame bricks are given.

REFERENCE NUMBERS

10 Frame brick
10*a* Whole frame brick
10*b* Half frame brick
10*c* Sliding frame brick
11 Brick cell
111 Cell width section
12 Brick body
121 Inner gap
13 Connection housing
14 Extension placement frame
15 Connection extension
151 Extension opening
16 Joining line
161 Production opening
17 Brick width section
18 Side surface
181 Connection recess
182 Connection protrusion
19 Brick length section
20 Wall surface
201 Cutout
202 First wall corner
21 Support part
211 Passage opening
212 Second wall corner
22 Coating plate
30 Wall

DETAILED DESCRIPTION OF THE INVENTION

In this detailed description, the subject matter structure elements are explained with references to examples without forming any restrictive effect only in order to make the subject more understandable.

Figure 1A:
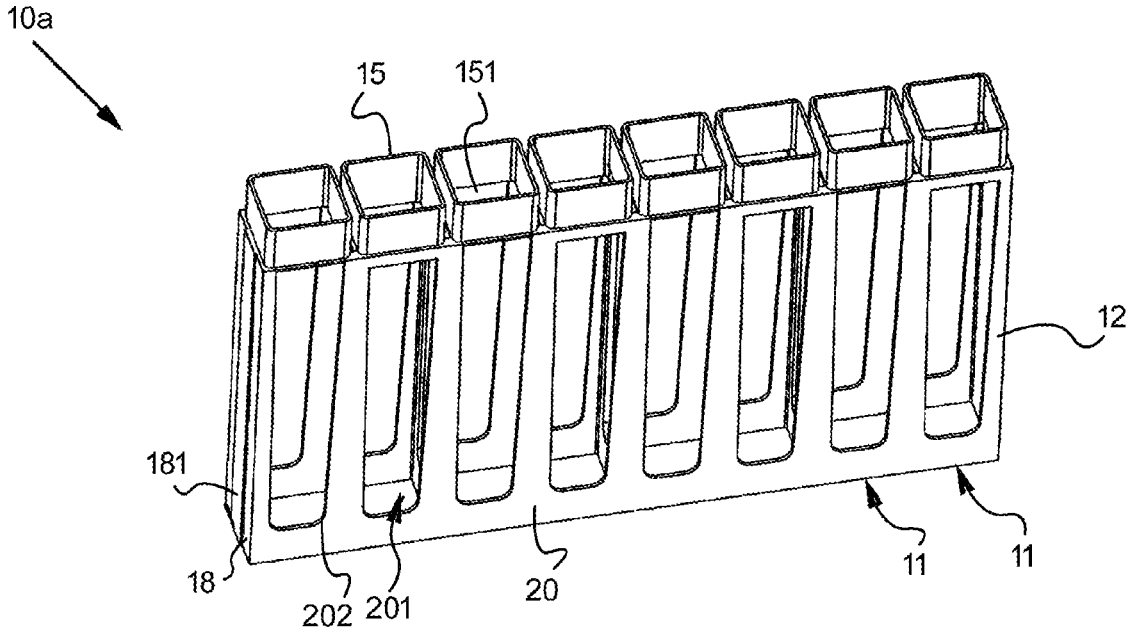
In FIGS. 1*a*, 1*b*, 2*a* and 2*b*, the representative views related to the subject matter whole frame brick are given.
Figure 1B:
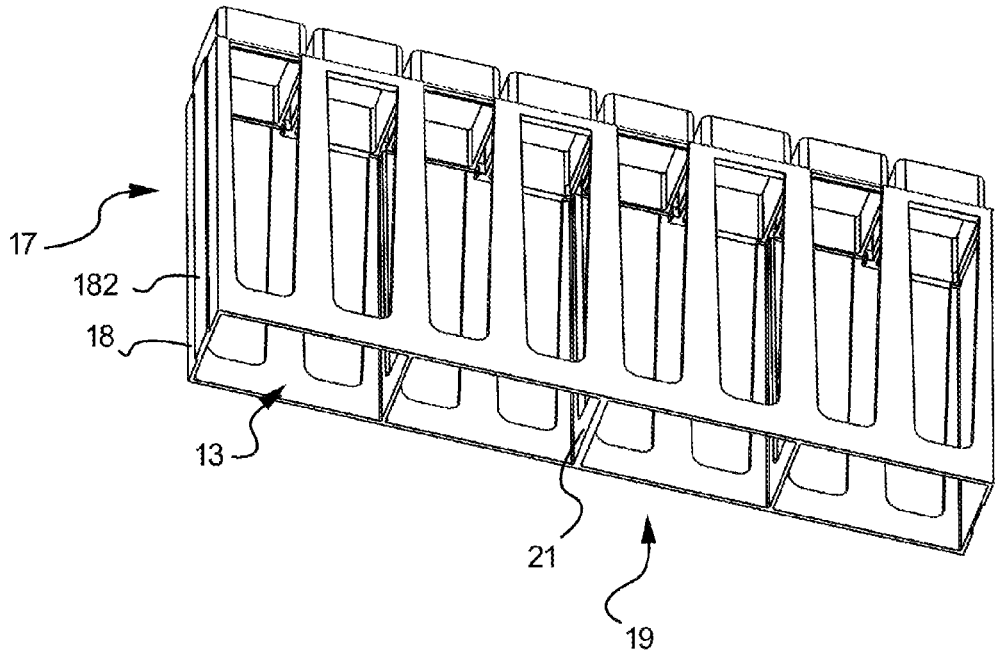
Figure 2A:
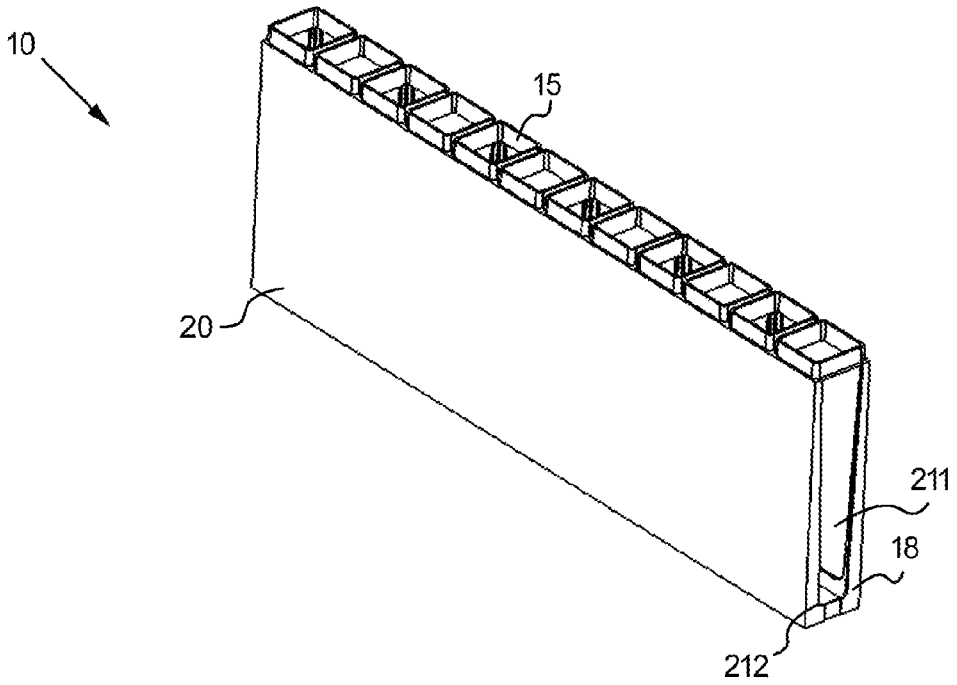
Figure 2B:
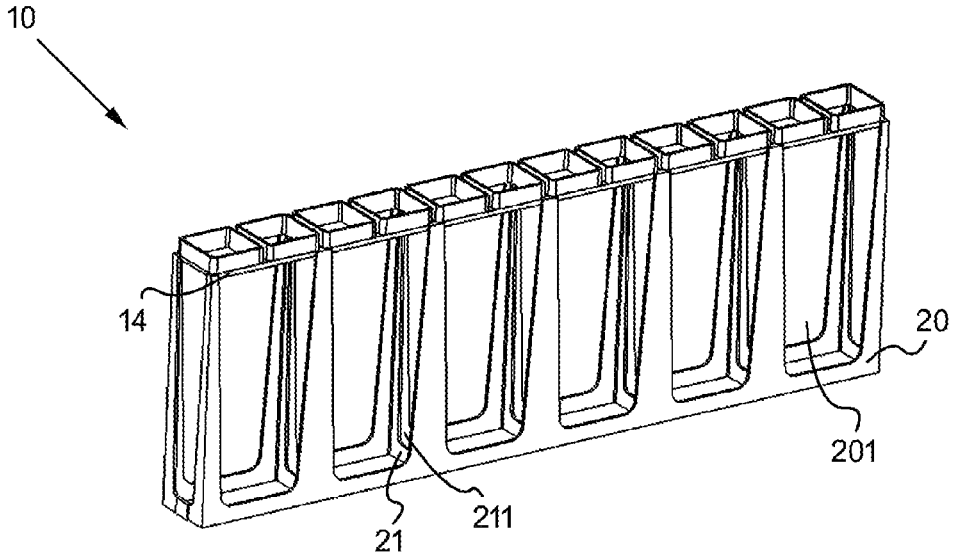

With reference to FIGS. 1*a* and 1*b*, the subject matter frame brick (10) at least has a brick body (12) which is in a form similar to a hollow box. The brick body (12) comprises at least one brick cell (11). In the preferred application, pluralities of brick cells (11) are arranged side by side in a one-piece manner and they form the brick body (12). By means of this, different lengths of frame bricks (10) are obtained. One side of the brick body (12) is defined as the connection housing (13). The other side of the brick body (12) is defined as an extension placement frame (14). The frame brick (10) has at least one connection extension (15) provided in a manner extending outwardly from the extension placement frame (14). An extension opening (151) is provided in the middle section of the connection extension (15). One each joining lines (16) are defined between the connection extensions (15) existing in the extension placement frame (14). At least one each production opening (161) is provided on the joining lines (16). The sides where the side surface (18) of the brick body (12) are defined as the brick width section (17) and the two sides where the mutual wall surfaces (20) are provided are defined as the brick length section (19). Depending on the location where it will be used in the structure, there is connection recess (181) or connection protrusion (182) on at least one of the side surfaces (18) of the brick body (12). At least one cutout (201) is provided on at least one of the wall surfaces (20) provided mutually. The cutout (201) is embodied in a rectangular form in the direction of the height of the brick body (12). The first wall corners (202) of the cutout (201) are embodied in a curved form. In the preferred application, the cutout (201) is formed towards the connection housing (13) in the vertical alignment of the connection extension (15). With reference to FIG. 2*b*, in one embodiment, one cutout (201) is provided on the wall surface (20) of the two adjacent brick cells (11). With reference to FIG. 2*a*, in an embodiment, there is cutout on a single wall surface (20). There are also frame bricks (10) having cutout (201) on the two mutual wall surfaces (20).

At least one support part (21) is provided which extends in the inner gap (121) of the brick body (12) in a manner contacting the two wall surfaces (20) and which extends along the height of the brick body (12) and at least along a section of the height of the brick body (12). In the preferred application, the support part (21) extends along the height of the brick body (12). At least one passage opening (211) is embodied on the support part (21). In the preferred application, the passage opening (211) is provided at the center of the support part (21). With reference to FIGS. 2*a* and 2*b*, the passage opening (211) is provided on at least one of the side surfaces (18) in one of the embodiments. There are also frame bricks (10) having passage openings (211) on both side surfaces (18). At least one second wall corner (212) of the passage openings (211) is embodied in a curved manner.

Figure 3A:
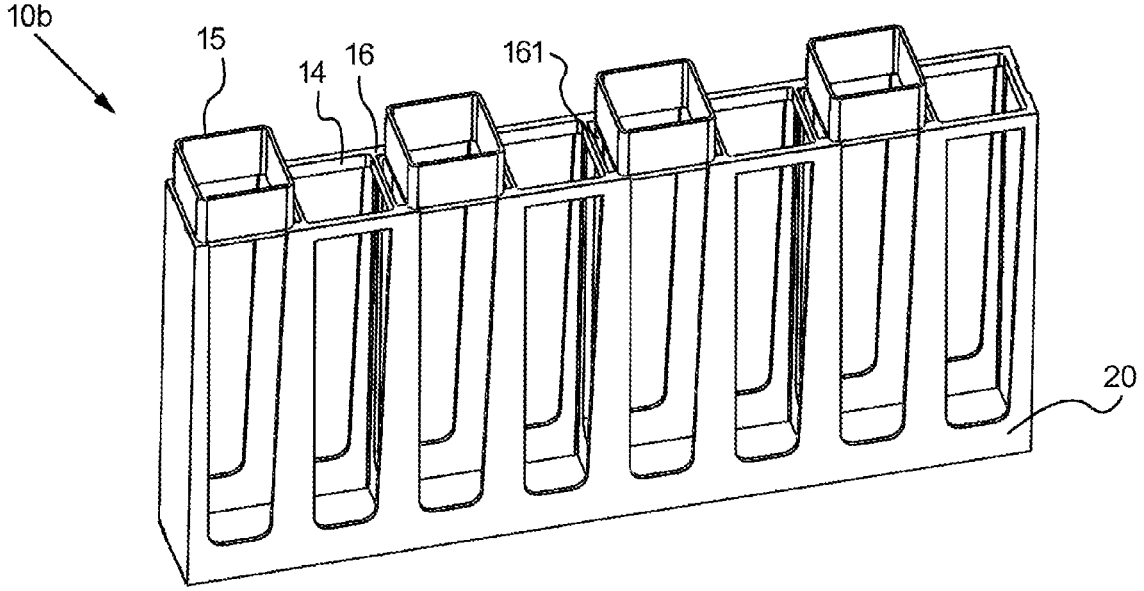
In FIGS. 3*a* and 3*b*, the representative views related to the subject matter half frame brick are given.
Figure 3B:
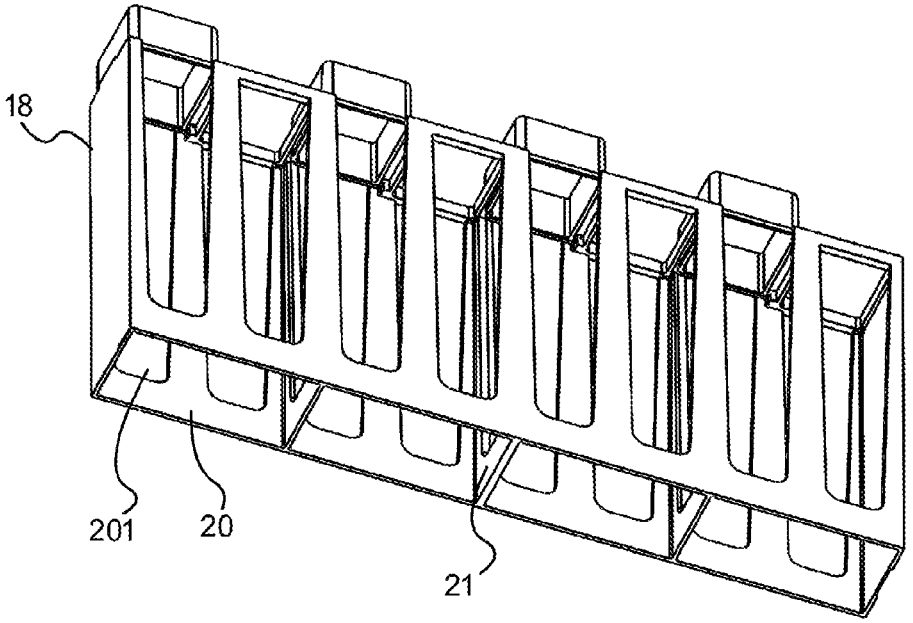

With reference to the figures between FIGS. 1*a* and 2*b*, the connection extension (15) is positioned on each brick cell (11) provided at the brick length section (19) in a whole frame brick (10*a*). With reference to FIGS. 3*a* and 3*b*, in a half frame brick (10*b*), the connection extensions (15) are respectively placed on one of both brick cells (11) at the brick length section (19).

Figure 4A:
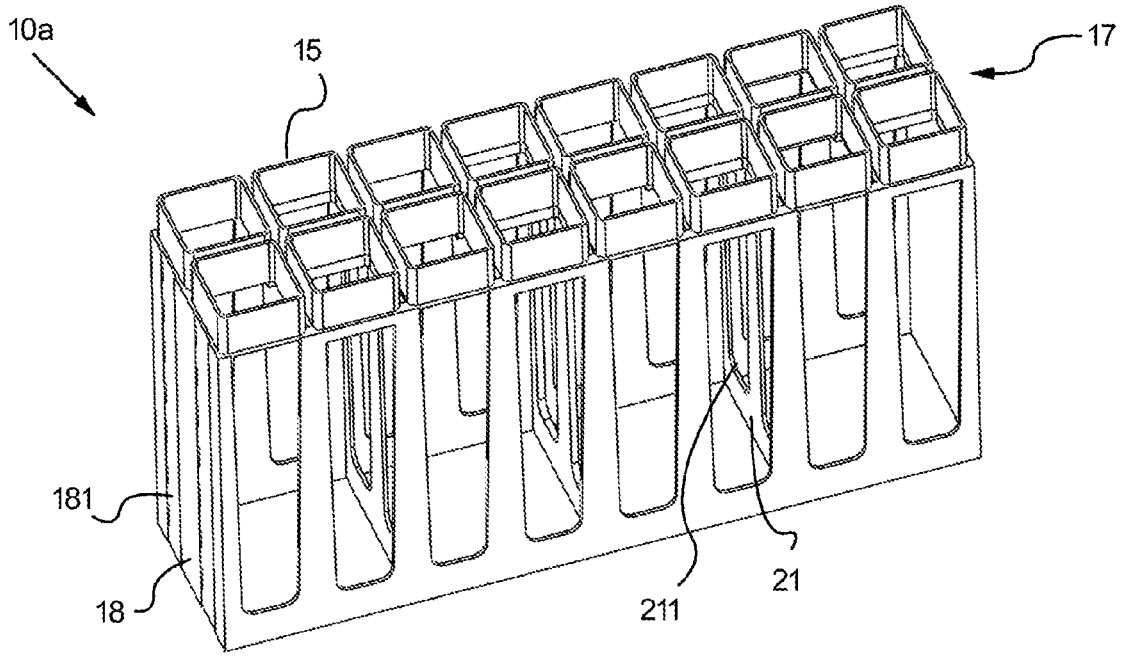
In FIGS. 4*a*, 4*b*, 5*a* and 5*b*, the representative views related to the whole frame brick having two brick cells in the width section are given.
Figure 4B:
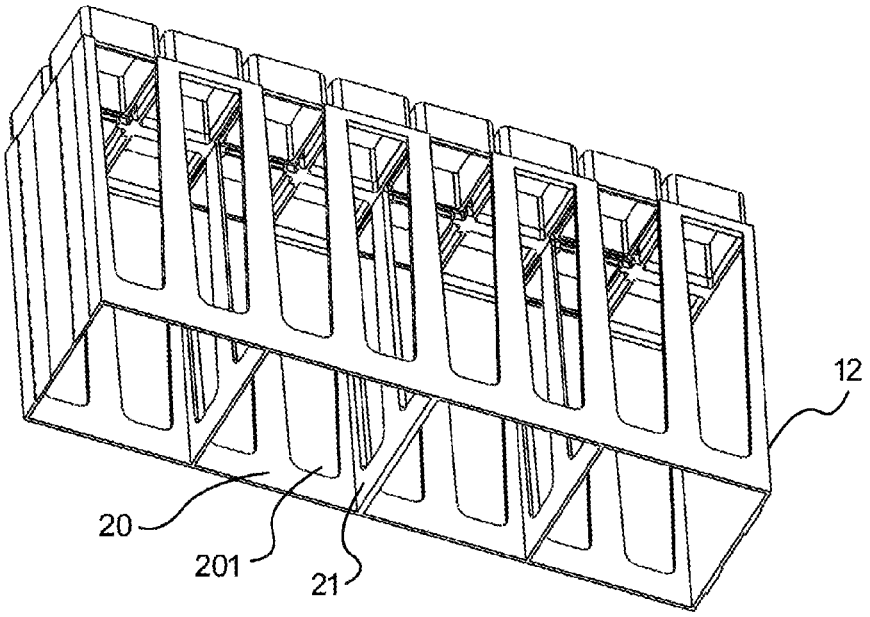
Figure 5A:
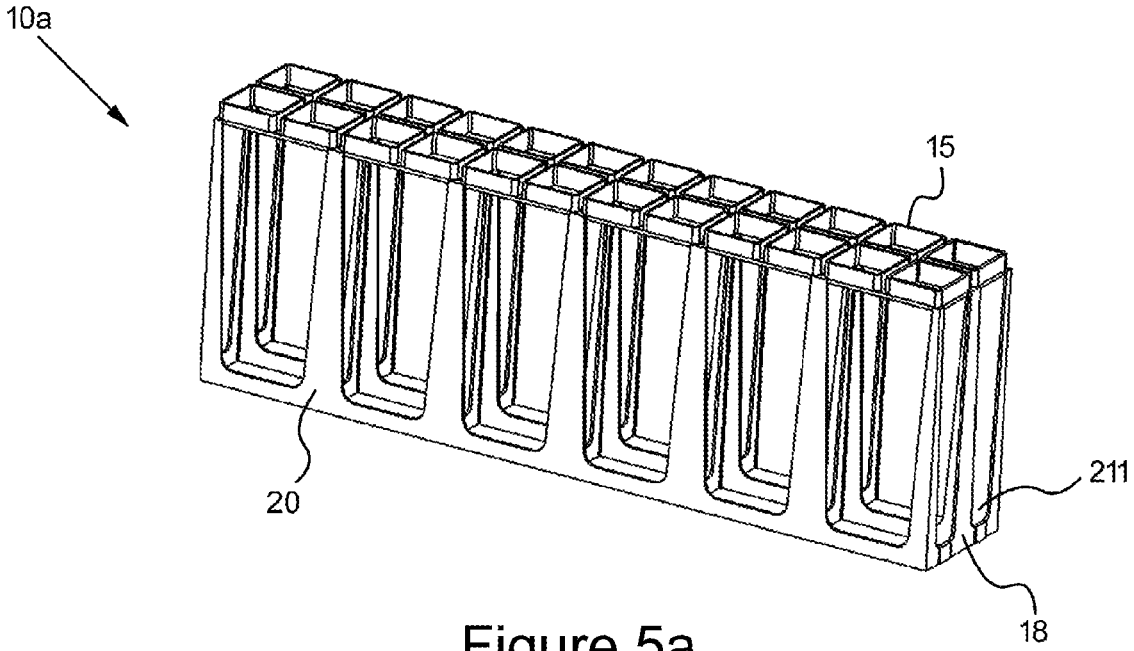
Figure 5B:
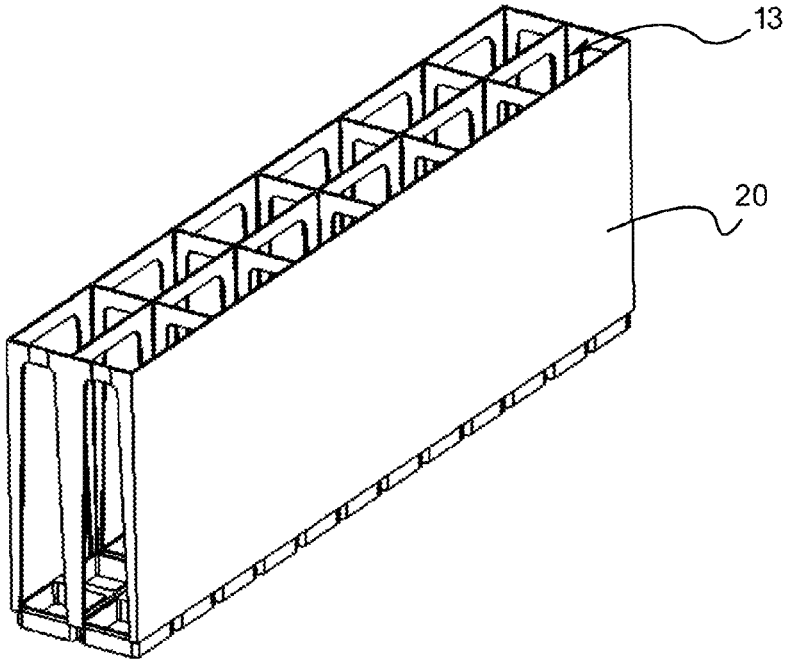
Figure 6A:
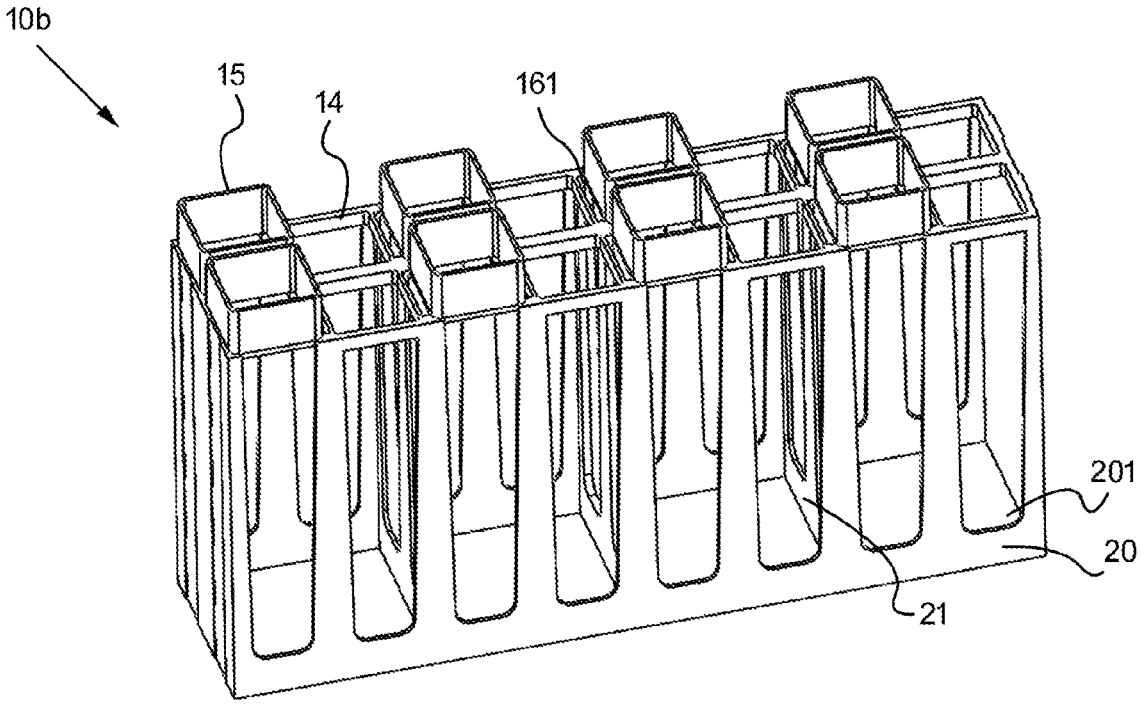
In FIGS. 6*a* and 6*b*, the representative views related to the half frame brick having two brick cells in the width section are given.
Figure 6B:
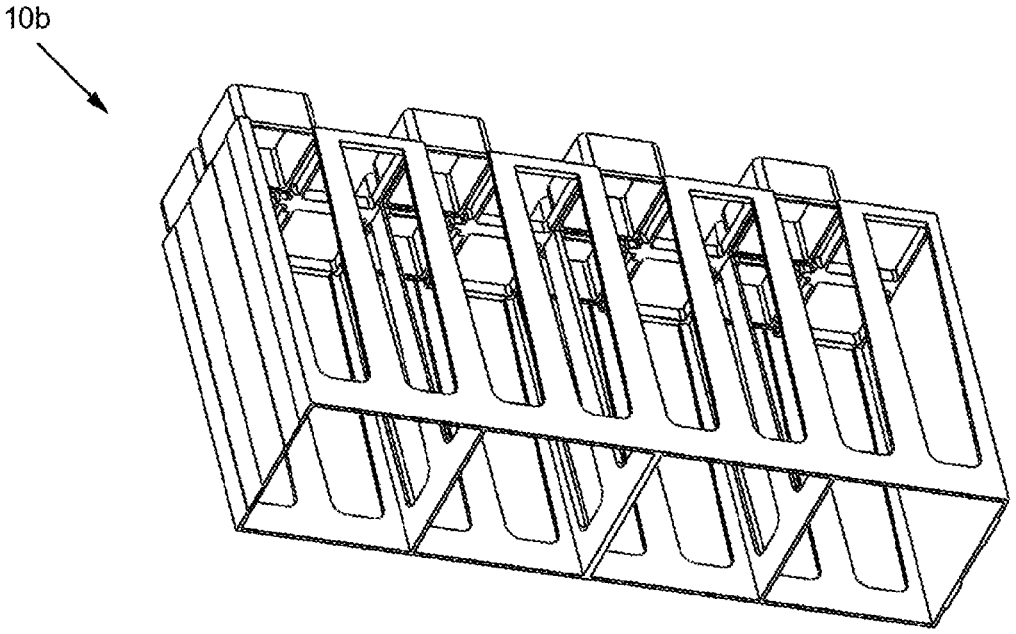

With reference to the figures between FIGS. 4*a* and 6*b*, in an alternative application, two brick cells (11) are provided at the brick width section (17) of the frame brick (10). Two passage openings (211), which extend preferably towards the connection housing (13) from both connection extensions (15) provided at the brick width section (17), are provided on the support parts (21).

With reference to the figures between FIGS. 7*a* and 10*b*, the frame bricks (10) can also be provided as sliding frame brick (10*c*). In the sliding frame brick (10*c*), the width of the cell width section (111) of at least one of the outermost brick cells (11) provided at the brick length section (19) is embodied in a shorter manner than the width of the brick width section (17) of the frame brick (10). In the preferred application, the width of the cell width section (111) of the outermost brick cell (11) is provided so as to be half of the width of the brick width section (17) of the frame brick (10). In case the sliding frame bricks (10*c*) have two brick cells (11) at the brick width section (17); the outermost brick cells (11), provided at the brick length section (19), are provided such that there are one each brick cells (11) at the brick width section (17).

Figure 11:
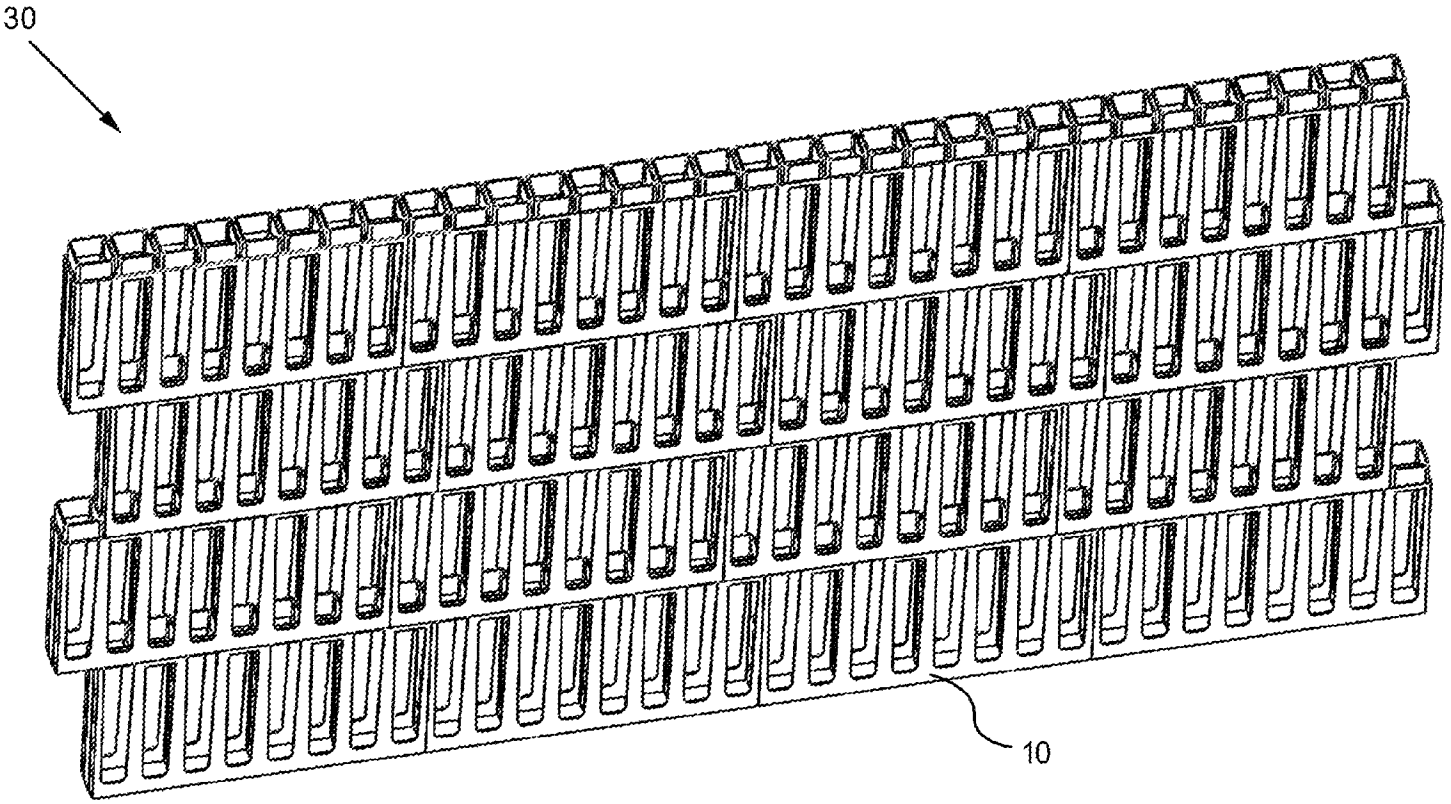
Figure 12:
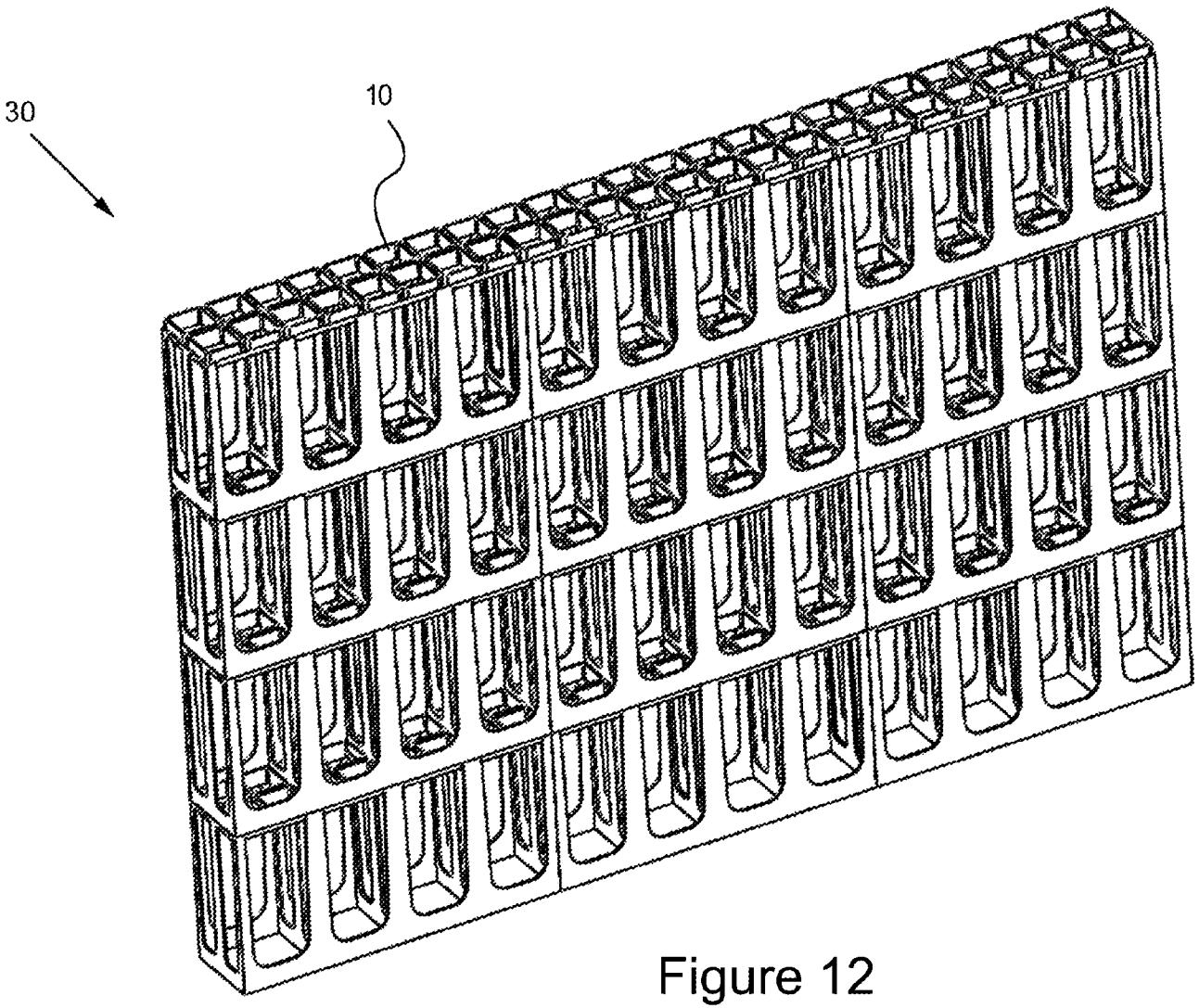
Figure 13:
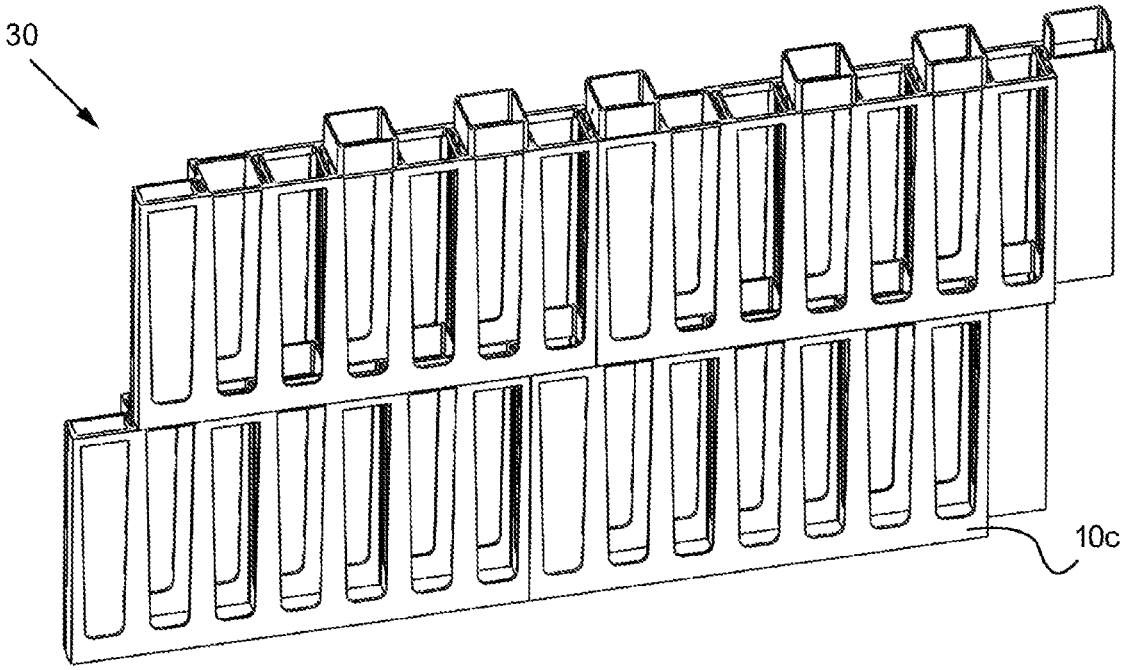
Figure 14:
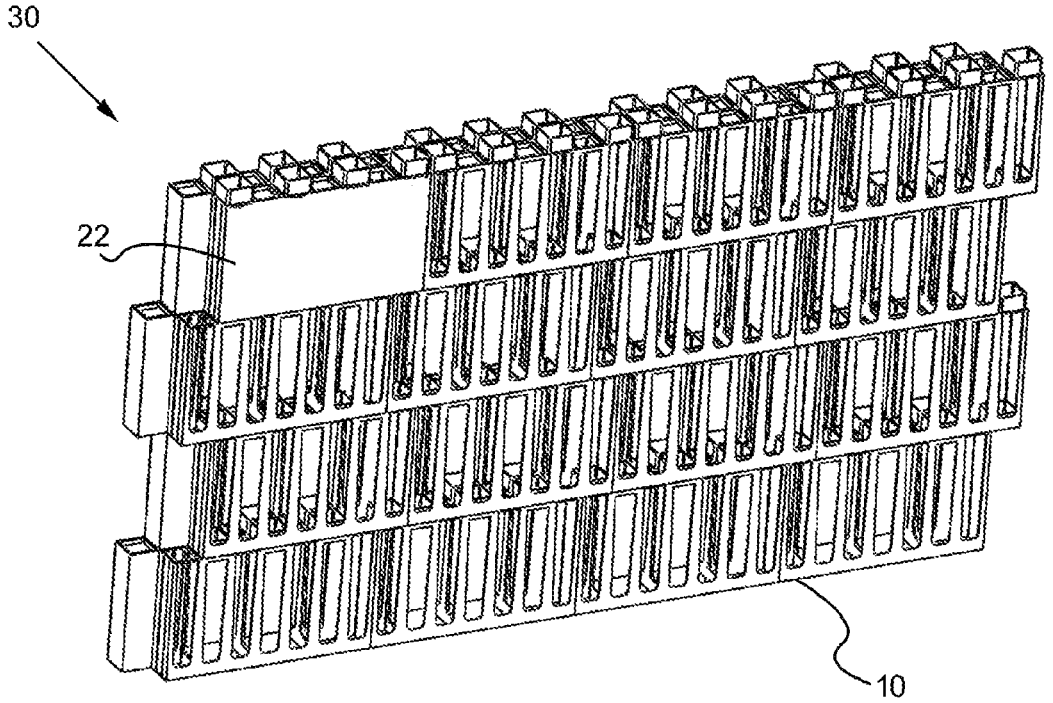

With reference to the figures between FIGS. 11 and 14, the frame bricks (10) are placed side by side and one above the other and the walls (30) of a structure are formed. The connection protrusion (182) provided on the side surface (18) of a frame brick (10) is placed to the connection recess (181) provided on the side surface (18) of the other frame brick (10) which is provided next thereto. By means of this, the frame bricks (10) can be placed side by side. The connection extension (15) of a frame brick (10) is placed to the connection housing (13) of the frame brick (10) positioned thereon. By means of this, the frame bricks (10) are positioned one above the other. When the frame bricks (10) are used which do not have connection item on the side surfaces (18) thereof, sliding furnishing shall be realized for the placement of the frame bricks (10). The frame bricks (10) are arranged side by side in a row, and the above frame brick (10) is connected simultaneously to at least two frame bricks (10) provided below. The outer brick cells (11) of the sliding frame brick (10*c*) complete each other and they are placed side by side.

The cutouts (201) provided on the wall surfaces (20) and the passage openings (211) provided on the support parts (21) and on the side surfaces (18) reduce the weight of the walls (30) which are formed by frame bricks (10); and thus, the cost of the walls (30) and of the structures are reduced. The load and pressure force in the structures are formed from the upper section of the wall (30) towards the floor. Since the cutouts (201) and the passage openings (211) extend in the height direction, the resistances of the frame bricks (10) do not decrease even if the frame bricks (10) are lightened and the resistances of the frame bricks (10) are not affected by the load and by the pressure force. As known in the art, a material, whose corners are curved, is more resistant than a material, whose corners are provided at 90 degrees, against a pressure exerted thereon. Therefore, since the first wall corners (202) of the cutouts (201) and the second wall corners (212) of the passage openings (211) are embodied in a curved manner, the resistance stays high.

Various insulation materials can be put to the inner gap (121) of the walls (30) formed by frame bricks (10). The insulation materials placed to the inner gap (121) of the frame bricks (10) increase the noise and thermal insulation of the wall (30). In a preferred application, rock wool is used as the insulation material. Thanks to the passage openings (211) of the support parts (21) provided in the inner gap (121) of the frame bricks (10), the insulation material can be placed to the inner gap (121) of the frame brick (10) along the brick length section (19). Moreover, installation materials can be passed through the inner gap (121) of the frame bricks (10). The cutouts (201) provided on the wall surfaces (20) and the passage openings (211) provided on the support parts (21) help placement of the installation materials along the whole frame brick (10). Moreover, when the frame bricks (10) are arranged side by side, insulation materials and installation materials can also be passed through the passage openings (211) provided on the side surface.

Frame bricks (10) are in general used for forming intermediate walls (30) in structures. Coating plates (22) are used for covering the wall surfaces (20) of the frame bricks (10) wherein insulation material is placed. In an exemplary application, plaster board coating plate on the intermediate walls (30) is coated onto the wall surfaces (20) of the frame bricks (10). The frame bricks (10) where only one of the wall surfaces (20) comprises cutout (201) are generally used on outer and carrier walls (30). In this case, an arrangement is realized such that the wall surface (20) comprising cutout (201) faces the inner part of the structure. Since there is no decrease in the resistance even if the frame bricks (10) are lightened, in an alternative application, the frame bricks (10), of which both wall surfaces (20) comprise cutout (201), can also form the carrier walls (30). In this case, coating is applied by means of coating plates (22) for the outer wall onto the wall surfaces (20). In an exemplary application, bordex coating plate is applied onto the wall surface (20) of the frame brick (10) facing outside of the building.

The frame bricks (10), used in the invention, are made of a material based on material named as SMC (sheet molding composites), and they are produced by means of a production method known in this area. In an alternative application, the frame bricks (10) are made of a material based on the material named as BMC (bulk molding composites). Accordingly, the frame bricks (10) of the invention can be produced in a compliant manner to injection production or hot pressing.

Accordingly, in a preferred formulation, said composite material comprises fiber between 25-33% by weight for providing resistance, at least one type of mineral powder between 40-50% by weight as filling material, resin between 20-25% by weight as binding the fiber to the filling material and at least one chemical additive between 5-8%. The resin in said invention is thermo-set resin.

ST steel values are determined according to the need of resistance in the structure. According to the determined ST value, a resin, vinyl ester resin can be selected from the isophthalic resin group. Moreover, a fiber is selected from the carbon fiber, glass fiber and aramid fiber group. The desired ST steel value is reached by forming resin and fiber combinations. Vinyl ester resin is preferred to be used as resin and carbon fiber is preferred to be used as fiber in order to obtain a material having relatively higher resistance, particularly having ST 52 steel values. At the sections where high resistance is not needed, isophthalic resin is preferred to be used as resin and glass fiber is preferred to be used as fiber for obtaining a material having relatively lower resistance, particularly having ST 37 steel values. At the sections where moderate resistance is needed, isophthalic resin is preferred to be used as resin and aramid fiber is preferred to be used as fiber, and thus, a material having ST 42 steel values can be obtained. In accordance to particular requirements, in order to reach ST values except the abovementioned values, isophthalic resin and carbon fiber are used, and vinyl ester resin and glass fiber are preferred to be used together. Preferably, the wall thickness of the subject matter frame bricks (10) can be between 4 mm and 2 cm depending on the desired resistance.

In the invention, the resin, provided in the composite material produced by means of SMC or BMC method, is thermo-set resin and thus, the density of the composite material is increased up to 3 g/cm$^3$. The density of the composite material becomes compliant to the mineral powder used in the composite material, and the filling material can be added to the material in proportion of 40-50%. Thanks to said compliancy, all of the mechanical resistances are increased, and since filling material, whose cost is lower than the cost of resin and fiber, can be used at a high proportion, the cost of the walls (30) formed by frame bricks (10) is reduced and thus the cost of the structure is reduced. The usage of the filling material at a high proportion also increases water resistance, temperature resistance, rigidity, surface smoothness and acid resistance in the structure. The filling material cannot be added at high proportion to every material as in the composite material. For instance, high density PE and similar plastic materials, where injection molding is realized, have lower density when compared with composite materials where SMC or BMC method is used. Therefore, addition of filling materials to the YYPE material at high proportion is prevented. The mineral powder, which can be added in proportion of 40-50% to said composite material in the invention, cannot be added to YYPE material due to the incompliancy which may occur. In details, the density of YYPE is approximately 1 g/cm$^3$ and it is very difficult to added mineral powder, having density up to 3 g/cm$^3$, into YYPE. Different density values lead to incompliancy between the mineral powder and YYPE, and the characteristics like tensile strength substantially decrease which may lead to usage of non-suitable structure elements in structures.

On the other hand, at least one type of mineral powder selected from a mineral group comprising silicium dioxide, barite, talc and calcite is used as the filling material, and at least one of the chemicals increasing resistance to flame and water absorption is used as the inorganic chemical additive. In addition to these, said formulation may moreover comprise thermoplastic material at a predetermined proportion in order to improve the surface appearance.

As known, the forces which a structure is subjected to may be classified under 5 titles, namely, tensile force, pressure force, momentum force, shearing force and twisting force. A structure may be simultaneously subject to one or some of these forces as a result of pluralities of external factors like earthquakes, winds, the own weight of the structure, and the structures shall be resistant to such conditions up to a specific degree. Accordingly, the behavior of the wall (30), produced by means of the subject matter frame bricks (10), against these forces has been described in general below.

First of all, the composite material, from which the frame bricks (10) are produced, is a material which is as resistant as steel, however, it is 6 times lighter than steel. On the other hand, the hollow body structure used in the invention and the cutouts (201) provided on the wall surfaces (20) reduces the weight of the frame bricks (10) more. Thus, the component of the momentum force, resulting from the weight of the walls (30) and from the own weight of a building, is very low when compared with concrete or steel structures. If the building is subject to a pressure force, the items like the connection recess (181) and the connection protrusion (182) provided on the side surfaces (18) of the adjacent frame bricks (10) and the connection extensions (15) and the connection housings (13) provided on the frame bricks (10) existing one above the other provide resisting of the structure against said pressure forces. In case a tensile force is formed, again, the connection housings (13) provided on the frame bricks (10) and the connection extensions (15) provide resisting of the structure against said pressure forces. When a cutting force is faced, the items in the pressure force are functioning, and in addition to this, the flexibility of the unscrewed connection provides a great advantage in this case. For instance, when a momentum force or a twisting force is formed due to a reason like wind, the flexibility characteristic provided thanks to the items providing resistance against the pressure forces and thanks to the unscrewed connection is functioning. Moreover, the connection items, providing interconnection of the frame bricks (10), play an important role for providing resistance of the walls and thus of the building against all of said forces. Since the frame bricks (10) are placed by means of sliding in every row, a frame brick (10), provided above, supports the interconnection of the two frame bricks (10) provided below, and this provides the walls (30) to be more rigid.

Moreover, the subject matter frame bricks (10) are not formed by pluralities of layers having different physical and chemical characteristics from each other as in the prior art, and this provides the subject matter frame bricks (10) and a wall (30) produced by using said frame bricks (10) to be substantially rigid and robust. Moreover, production easiness and production speed, provided by means of this, is an important advantage.

Some test data of the subject matter frame brick (10) obtained by means of an exemplary formulation is as follows:

| Tests | Test Method | Values |
|---|---|---|
| Determination of the Bending Resistance (N/mm$^2$) | TS 985 EN ISO 178 | ≥160 |
| Determination of the Tensile Strength (MPa) | EN ISO 527-4 | ≥222 |
| Impact Resistance (kj/m$^2$) | EN ISO 179 | ≥110 |
| Barcole Hardness | EN59 | 70 |
| Water absorption (%) | TS 702, ISO 62 | Maximum 0.15% within 24 hours |
| Density (g/cm$^3$) | TS 1818, ASTM D792 | 1.79 |
| Chemical Resistance (Under conditions of 168 ± | EN ISO 14125 | Change in weight: maximum 0.5% |

-continued

| Tests | Test Method | Values |
|---|---|---|
| hours at 23 ± 2° C. with 60% toluene 40% n-heptane or diesel by volume) (TS 1478 EN 124 Annex E) | | Change in bending resistance: −20% Change in bending module: −30% |
| Surface Resistance (Ω) | DIN IEC 93 | $5 \times 10^{9}$ |
| Volume Resistance (Ω) | DIN IEC 93 | $5 \times 10^{10}$ |
| Specific Passage Resistance (Ω · cm) | DIN IEC 93 | $1 \times 10^{12}$ |
| Ball Pressure Test | | Trace diameter: maximum 2 mm. |
| Glow Wire Test | | There is no dripping |
| Accelerated Heat Dampening Test | | There is no punch and deformation |
| Insulation Test | | There is no discharge and deformation |
| Test of Resistance to Temperature Changes | | There is no deformation and crack |
| Test of Resistance to Ultraviolet Rays | | There is no deformation and crack |

Moreover, in the related tests realized, it has been observed that the subject matter frame bricks (10) do not have dripping problem in the glow wire test, and there is no punch and deformation in the accelerated heat dampening test, and there is no discharge and deformation in the insulation test. Additionally, it has been observed that no deformation and cracks have occurred in the subject matter frame bricks (10) during the test of resistance to temperature changes and test of resistance to ultraviolet rays. Moreover, the frame bricks (10) with the abovementioned characteristics are not affected by humidity, and their thermal and noise insulations are at a high level.

The protection scope of the present invention is set forth in the annexed Claims and cannot be restricted to the illustrative disclosures given above, under the detailed description. It is because a person skilled in the relevant art can obviously produce similar embodiments under the light of the foregoing disclosures, without departing from the main principles of the present invention.

The invention claimed is:

1. A frame brick having a brick body made of composite material and which is in hollow box form and which comprises at least one type of fiber and at least one type of resin, and at least one connection extension which is one-piece with said brick body and which provides connection to another structure element with the same characteristics, wherein the brick body includes two wall surfaces extending facing each other on a brick length section of the brick body, and wherein at the two wall surfaces each enclose at least one aperture at least partially in a direction of a height of the brick body for reducing the weight of the frame brick, wherein the at least one aperture of each of the two wall surfaces are respectively aligned in a brick width section perpendicular to the brick length section.

2. The frame brick according to claim 1, wherein at least one first wall corner of the at least one aperture is curved.

3. The frame brick according to claim 1, wherein at least one production opening is provided which is positioned on defined by at least one joining line extending between the two wall surfaces.

4. The frame brick according to claim 1, wherein at least one connection recess or at least one connection protrusion is provided on at least one of two side surfaces facing another frame brick which is horizontally adjacent.

5. The frame brick according to claim 1, wherein the brick body comprises at least one brick cell.

6. The frame brick according to claim 1, wherein the brick body comprises pluralities of brick cells arranged side by side in a one-piece manner.

7. The frame brick according to claim 6, wherein one of the at least one apertures is provided on one of the two wall surfaces at two adjacent brick cells.

8. The frame brick according to claim 1, wherein at least one support part is provided which extends along at least one section of the height of the brick body in a manner contacting the two wall surfaces in an inner gap of the brick body.

9. The frame brick according to claim 8, wherein at least one passage opening is provided on the at least one support part at least partially in the direction of the height of the brick body.

10. The frame brick according to claim 1, wherein at least one passage opening is provided at least partially in the direction of the height of the brick body on at least one of the two side surfaces facing another frame brick which is horizontally adjacent.

11. The frame brick according to claim 9, wherein at least one second wall corner of the at least one passage opening is curved.

12. The frame brick according to claim 6, wherein two connection extensions of the at least one connection extension are provided on each brick cell of the pluralities of brick cells provided in the brick length section.

13. The frame brick according to claim 6, wherein two connection extensions of the at least one connection extension are provided respectively on one of the pluralities of brick cells provided in the brick length section.

14. The frame brick according to claim 6, wherein two brick cells of the pluralities of brick cells are provided in the brick width section of the frame brick.

15. The frame brick according to claim 6, wherein a width of a cell width part of at least one outermost brick cell of the pluralities of brick cells in the brick length section is smaller than a width of the brick width section.

16. The frame brick according to claim 1, wherein said frame brick is made of a composite material comprising at least one type of fiber between 25-33% by weight for providing resistance, at least one type of mineral powder between 40-50% by weight as filling material, at least one type of resin between 20-25% by weight for binding the fiber to the filling material and at least one chemical additive between 5-8% by weight.

17. The frame brick according to claim 1, wherein vinyl ester resin is provided as said at least one type of resin and carbon fiber is provided as said at least one type of fiber, in order to obtain a material having mechanical properties of steels which are ST 50 and above.

18. The frame brick according to claim 1, wherein ortophthalic resin is provided as said at least one type of resin and glass fiber is provided as said at least one type of fiber, in order to obtain a material having mechanical properties of steels which are between ST 33 and ST 42.

19. The frame brick according to claim 1, wherein isophthalic resin is provided as said at least one type of resin and aramid fiber is provided as said at least one type of fiber, in order to obtain a material having the mechanical properties of steels which are between ST 42 and ST 50.

20. The frame brick according to claim 1, wherein as a filling material, at least one type of mineral powder is provided, which is selected from a mineral group comprising silicium dioxide, barite, talc and calcite.

21. The frame brick according to claim 1, wherein as a chemical additive, at least one of chemicals which increase resistance to water absorption, resistance to flame and resistance to abrasion is provided and a predetermined proportion of thermoplastic material is provided for improving surface appearance.

22. The frame brick according to claim 1, wherein at least one insulation material is provided in an inner gap of the brick body.

23. The frame brick according to claim 1, wherein at least one coating plate is provided on the at least one of the two wall surfaces provided with said at least one aperture.

24. The frame brick according to claim 23, wherein the coating plate is plaster board plate.

25. A wall defined by connection of at least two frame bricks to each other which are according to claim 1.

26. The frame brick according to claim 5, wherein one of the at least one apertures is in vertical alignment with one of the at least one connection extensions in one of the at least one brick cells.

* * * * *